US009041755B2

(12) United States Patent
Kueckendahl et al.

(10) Patent No.: US 9,041,755 B2
(45) Date of Patent: May 26, 2015

(54) MARKING APPARATUS

(75) Inventors: Peter Joerg Kueckendahl, Bad Oldesloe (DE); Daniel Joseph Ryan, Sycamore, IL (US)

(73) Assignee: ALLTEC ANGEWANDTE LASERLICHT TECHNOLOGIE GMBH, Selmsdork (DE)

( * ) Notice: Subject to any disclaimer, the term of this patent is extended or adjusted under 35 U.S.C. 154(b) by 0 days.

(21) Appl. No.: 13/977,159

(22) PCT Filed: Dec. 22, 2011

(86) PCT No.: PCT/EP2011/006521

§ 371 (c)(1),
(2), (4) Date: Jun. 28, 2013

(87) PCT Pub. No.: WO2012/089326

PCT Pub. Date: Jul. 5, 2012

(65) Prior Publication Data

US 2013/0286149 A1 Oct. 31, 2013

(51) Int. Cl.

| | |
|---|---|
| ***B41J 2/435*** | (2006.01) |
| ***B41J 2/46*** | (2006.01) |
| ***B41J 2/21*** | (2006.01) |

(Continued)

(52) U.S. Cl.

CPC ..... *B41J 2/435* (2013.01); *B41J 2/16579* (2013.01); *B41J 2/2142* (2013.01); *B41J 2/46* (2013.01); *B41J 3/4073* (2013.01)

(58) Field of Classification Search

CPC ..... B41J 2/46; B41J 2/435; B41J 2/2142; B41J 2/16579

USPC ..... 347/236, 242, 245, 246, 225

See application file for complete search history.

(56) References Cited

U.S. PATENT DOCUMENTS

| | | | | |
|---|---|---|---|---|
| 4,707,063 | A | 11/1987 | Plummer | |
| 5,399,032 | A | 3/1995 | Itoh et al. | |
| 5,477,259 | A * | 12/1995 | Iwasa | 347/238 |

(Continued)

FOREIGN PATENT DOCUMENTS

| | | |
|---|---|---|
| DE | 2401322 | 1/1974 |
| DE | 3826113 A1 | 2/1989 |

(Continued)

OTHER PUBLICATIONS

International Application No. PCT/EP2011/006521, Written Opinion of International Search Authority.

(Continued)

*Primary Examiner* — Sarah Al Hashimi
(74) *Attorney, Agent, or Firm* — Hoffman Warnick LLC

(57) ABSTRACT

The invention relates to a marking apparatus (10) for marking an object comprising a marking head (20) having a plurality of marking devices (40, 40*a*, 40*b*) for applying a marking on the object and a driving mechanism for providing a relative movement of the object relative to the marking head in an advance direction (16) during a marking operation. The marking head comprises in addition to the plurality of marking devices a plurality of sensor devices and the sensor devices (50) are arranged down-stream of the marking devices in the advance direction, so that the marking applied by the marking devices is detectable by the sensor devices, when the object is moved relative to the marking head in the advance direction. The invention also relates to a method for marking an object.

10 Claims, 10 Drawing Sheets

(51) Int. Cl.

| | |
|---|---|
| ***B41J 2/165*** | (2006.01) |
| ***B41J 3/407*** | (2006.01) |

(56) References Cited

U.S. PATENT DOCUMENTS

| | | | |
|---|---|---|---|
| 5,777,634 | A | 7/1998 | Okamura et al. |
| 5,784,098 | A | 7/1998 | Shoji et al. |
| 6,189,991 | B1 | 2/2001 | Wen et al. |
| 6,286,927 | B1 | 9/2001 | Taneya et al. |
| 6,381,377 | B1 | 4/2002 | Wang |
| 6,469,729 | B1 | 10/2002 | Ryan |
| 6,738,086 | B2 | 5/2004 | Oka |
| 6,855,921 | B1 | 2/2005 | Stopperan et al. |
| 7,354,130 | B2 | 4/2008 | Arakawa |
| 7,448,719 | B1 | 11/2008 | Newell |
| 7,564,020 | B2 | 7/2009 | Sergyeyenko |
| 7,671,337 | B1 | 3/2010 | Tidwell |
| 7,908,968 | B2 | 3/2011 | McCoin et al. |
| 2002/0001004 | A1 | 1/2002 | Mantell et al. |
| 2002/0101469 | A1 | 8/2002 | Wade et al. |
| 2002/0109741 | A1 | 8/2002 | Okabe et al. |
| 2002/0139273 | A1 | 10/2002 | Murata et al. |
| 2002/0191069 | A1 | 12/2002 | Oka |
| 2003/0016348 | A1 | 1/2003 | Sallee |
| 2003/0210861 | A1 | 11/2003 | Weiss et al. |
| 2003/0235373 | A1 | 12/2003 | Ishii et al. |
| 2004/0160478 | A1 | 8/2004 | Weijkamp et al. |
| 2005/0122548 | A1 | 6/2005 | Cunnigan et al. |
| 2005/0123303 | A1 | 6/2005 | Guttman et al. |
| 2005/0140770 | A1 | 6/2005 | Kang et al. |
| 2005/0286093 | A1 | 12/2005 | Sumi et al. |
| 2006/0066924 | A1 | 3/2006 | Delueg |
| 2006/0109525 | A1 | 5/2006 | Evans |
| 2007/0091132 | A1 | 4/2007 | Lim |
| 2007/0279713 | A1 | 12/2007 | Feng et al. |
| 2008/0055352 | A1 | 3/2008 | Toh et al. |
| 2008/0246962 | A1 | 10/2008 | Yang |
| 2009/0267977 | A1* | 10/2009 | Sumi ..... 347/9 |
| 2010/0002057 | A1 | 1/2010 | Hatasa et al. |
| 2010/0214387 | A1 | 8/2010 | Fox et al. |
| 2010/0231929 | A1 | 9/2010 | Kakigi |
| 2013/0021398 | A1 | 1/2013 | Mizes et al. |
| 2013/0286147 | A1 | 10/2013 | Kueckendahl et al. |
| 2013/0286148 | A1 | 10/2013 | Kueckendahl et al. |
| 2013/0286149 | A1 | 10/2013 | Kueckendahl et al. |
| 2013/0293658 | A1 | 11/2013 | Kueckendahl et al. |
| 2013/0328978 | A1 | 12/2013 | Sekino et al. |
| 2013/0342823 | A1 | 12/2013 | Kueckendahl et al. |

FOREIGN PATENT DOCUMENTS

| | | | |
|---|---|---|---|
| EP | 0121369 | A2 | 10/1984 |
| EP | 0832754 | B1 | 12/1993 |
| EP | 0832752 | A2 | 4/1998 |
| EP | 1266763 | A1 | 12/2002 |
| EP | 1640169 | A3 | 9/2005 |
| EP | 1640169 | A2 | 3/2006 |
| EP | 2105309 | A1 | 9/2009 |
| JP | 59136267 | | 8/1984 |
| JP | 05185686 | | 7/1993 |
| JP | 2001332806 | A | 11/2001 |
| JP | 2007090814 | A | 4/2007 |
| JP | 2008126471 | A | 6/2008 |
| JP | 2009037128 | A | 2/2009 |
| WO | 8505187 | A1 | 11/1985 |
| WO | 2006037973 | A1 | 4/2006 |
| WO | 2007107030 | A1 | 9/2007 |
| WO | 20080104222 | A1 | 9/2008 |
| WO | 2009153795 | A1 | 12/2009 |

OTHER PUBLICATIONS

International Application No. PCT/EP2011/006521, Written Opinion of International Examining Authority.
U.S. Appl. No. 13/976,804, Office Action dated Jul. 8, 2014.
U.S. Appl. No. 13/976,804, Notice of Allowance dated Mar. 20, 2014.
U.S. Appl. No. 13/976,809, Office Action dated May 27, 2014.
U.S. Appl. No. 13/977,159, Office Action dated Jun. 20, 2014.
U.S. Appl. No. 13/976,832, Notice of Allowance and Fees Due dated Jun. 24, 2014.
U.S. Appl. No. 13/976,793, Office Action dated Jul. 1, 2014.
U.S. Appl. No. 13/977,151, Notice of Allowance and Fees Due dated Aug. 4, 2014.
U.S. Appl. No. 13/977,156, Office Action dated Jul. 9, 2014.
International Application No. PCT/EP2011/006518, Written Opinion of International Search Authority.
International Application No. PCT/EP2011/006514, Written Opinion of International Search Authority.
International Application No. PCT/EP2011/006516, Written Opinion of International Search Authority.
International Application No. PCT/EP2011/00652023, Written Opinion of International Search Authority.
International Application No. PCT/EP2011/006516, International Search Report, dated Mar. 23, 2012, 3 pages.
International Application No. PCT/EP2011/006519, Written Opinion of International Search Authority.
International Application No. PCT/EP2011/006519, Preliminary Report on Patentability.
International Application No. PCT/EP2011/006515, International Preliminary Report on Patentability, Jan. 21, 2013.
International Application No. PCT/EP2011/006515, Written Opinion on Search Report.
U.S. Appl. No. 13/976,832, Notice of Allowance dated Oct. 8, 2014, A593, 61 pages.
U.S. Appl. No. 13/976,814, Notice of Allowance dated Oct. 21, 2014, A581, 72 pages.
U.S. Appl. No. 13/976,804, Final Office Action dated Oct. 24, 2014, A585, 18 pages.
U.S. Appl. No. 13/976,779, Office Action dated Jun. 16, 2014, A601, 13 pages.
U.S. Appl. No. 13/976,779, Notice of Allowance dated Oct. 21, 2014, A601, 34 pages.
International Application No. PCT/EP2011/006520, Written Opinion of International Search Authority.
International Application No. PCT/EP2011/006522, Written Opinion of International Search Authority.
International Application No. PCT/EP2011/006522, International Report on Patentability.
International Application No. PCT/EP2011/006517, Written Opinion of International Search Authority.
U.S. Appl. No. 13/977,156, Final Office Action dated Dec. 5, 2014, A617, 13 pages.
U.S. Appl. No. 13/976,793, Notice of Allowance dated Dec. 9, 2014, A609, 66 pages.
U.S. Appl. No. 13/976,814, Notice of Allowance Dated Dec. 29, 2014, A581, 10 pages.
U.S. Appl. No. 13/976,804, Notice of Allowance, Feb. 3, 2015.
U.S. Appl. No. 13/976,793, Notice of Allowance, Feb. 4, 2015, 16 pages.
U.S. Appl. No. 13/976,779, Notice of Allowance, Feb. 6, 2015, 18 pages.
U.S. Appl. No. 13/976,809, Office Action, Feb. 6, 2015, 78 pages.
U.S. Appl. No. 13/977,151, Office Action, Feb. 17, 2015, 70 pages.

* cited by examiner

MARKING APPARATUS

FIELD OF THE INVENTION

The present invention relates to a marking apparatus for marking an object. The invention also relates to a method for marking an object.

RELATED ART

The known marking apparatus comprises a marking head having a plurality of marking devices for applying a marking on the object and a driving mechanism for providing a relative movement of the object relative to the marking head in an advance direction during a marking operation.

In the known method, which can in particular be carried out with a marking apparatus as described above, a marking is applied by a plurality of marking devices and the object is moved relative to the marking devices in an advance direction during a marking operation.

In the known marking apparatus and marking method it is a general problem that one or more marking devices might fail or not be operated correctly during a marking operation. Such a failure or malfunction of one or more marking devices may adversely affect the applied marking, so that the marking may for example lack one or more pixels.

The defect in the marking might not be perceived by an operator during a certain runtime of the marking apparatus, so that a number of marked objects might have to be discarded due to an insufficient quality of the marking.

SUMMARY OF THE INVENTION

It is therefore an object of the invention to provide a marking apparatus and method for marking allowing for a high quality of the markings.

The object is solved according to the invention by a marking apparatus and a method. Preferred embodiments are given in the dependent claims.

The marking apparatus may be characterized in that the marking head comprises in addition to the plurality of marking devices a plurality of sensor devices and the sensor devices are arranged downstream of the marking devices in the advance direction, so that the marking applied by the marking devices is detectable by the sensor devices, when the object is moved relative to the marking head in the advance direction.

The method may be characterized in that the marking applied by the marking devices is detected by a plurality of sensor devices, which are arranged downstream of the marking devices in the advance direction.

One idea of the invention is to provide an integrated marking and sensor apparatus for applying a marking on the object and detecting the presence of the applied marking. The integrated marking and sensor apparatus, which may also be referred to as an integrated marking and scanning apparatus, may allow for a high quality of the marking, as a failed or damaged marking device will instantly be detected by one of the sensor devices, such that the marking apparatus may be stopped and/or an operator may be notified.

An idea of the invention is to arrange the sensor devices and the marking devices in one common marking head, which may also be referred to as an integrated marking and sensor head or an integrated marking and scanning head. In particular, the marking devices and the sensor devices may be arranged in a fixed relative position to each other in the marking head.

The marking devices may in particular be marking devices for marking, printing and/or engraving the object with at least one laser beam. In a preferred embodiment the marking devices comprise a ferrule with a fibre coupled to a laser device. However, the marking devices can also include other types of marking devices such as inkjet nozzles, thermal printing devices, needle printing devices, micro pad printing devices, water jets, and/or electrical discharge machining devices. It is also possible to include different types of marking devices in the marking head.

The sensor devices may for example comprise a ferrule with a fibre arranged therein, a PIN diode, a photodiode, a phototransistor, a micro antenna, a capacity sensor element, an inductive sensor element and/or a chemical sensor element. The sensor devices may in particular be optical sensors devices. The sensor devices may be configured to detect a colour profile on the object.

In a preferred embodiment, the marking apparatus is a printing apparatus for printing or engraving an object by means of at least one laser beam.

In a method for marking or printing the object, the object may be in particular marked or printed by successively operating the individual marking devices, that is, the marking is applied line by line or pixel by pixel. In the same manner, the sensor devices are also operated successively, so that a marking may be scanned line by line or pixel by pixel, while the object is moved relative to the marking head.

In a preferred embodiment of the invention the marking head comprises a plurality of receiving spaces, in which the marking devices and the sensor devices are arranged. The marking devices and the sensor devices may be preferably each configured to be engaged with the receiving spaces of the marking head.

For a flexible arrangement of the marking devices and sensor devices, it may be preferred that the receiving spaces are adapted to selectively receive marking devices and sensor devices, that is, a receiving space may be selectively equipped with a marking device or a sensor device. In a preferred embodiment the receiving spaces have equal configurations, so that the positions of marking devices and sensor devices may be changed, in particular interchanged.

In another preferred embodiment, the marking devices and the sensor devices have corresponding connector sections for being variably or selectively coupled to or engaged with the receiving spaces of the marking head. In other words, both marking devices and the sensor devices are configured to be engaged with the receiving spaces of the marking head. This may provide flexible marking apparatus, because the arrangement of the marking devices and the sensor devices may be adapted to a given marking task.

It may be preferred according to the invention that the receiving spaces are arranged in a plurality of rows and columns, such that a two-dimensional array of receiving spaces is formed. When marking and scanning an object, the marking devices and sensor devices may be operated to apply a marking pixel by pixel and scan the marked object pixel by pixel. The plurality of rows and columns may in particular be employed for an enhancement of marking and/or scanning speed or an enhancement of marking and/or scanning resolution. The plurality of rows also allows for using at least one row exclusively for marking devices and a successive row exclusively for sensor devices.

In a preferable configuration the rows and columns, in which the receiving spaces are arranged, extend perpendicular to each other. In other words, it may be preferred that the receiving spaces are arranged in a two-dimensional array with a rectangular pattern of the receiving spaces. The rectangular pattern of receiving spaces, which may also be called an orthogonal pattern or arrangement of the receiving spaces, includes a plurality of rows and columns, in which the receiving spaces arranged, wherein the rows and columns extend perpendicularly to each other. The rows of the two- dimensional array preferably extend in a transverse direction, that is, a direction that extends transversely to the advance direction. It may be preferred that the receiving spaces have equal pitches, that is, equal distances between the central points between adjoining receiving spaces, in the row and/or in the column direction. Such a regular pattern provides a uniform marking and/or scanning resolution.

In another preferred embodiment of the invention the array of receiving spaces is tilted with regard to the advance direction such that the rows extend in a transverse direction relative to the advance direction and the receiving spaces of a successive row are offset with regard to the receiving spaces of a preceding row in the transverse direction, in particular in a direction perpendicular to the advance direction. With such a tilted or inclined position of the array the resolution of the marking head can be enhanced.

It may be particularly preferred that an array with a rectangular pattern of the receiving spaces is tilted. In the tilted position of the rectangular pattern array, the rows of individual receiving spaces extend transversely, but not perpendicularly, to the advance direction. Consequently, as the rows extend perpendicularly to the columns, the columns of receiving spaces also extend transversely to the advance direction. The array of receiving spaces is thus rotated or tilted from a position, in which the columns are aligned with the advance direction, to a position, in which the columns are at least slightly inclined or slanted with regard to the advance direction. A preferred tilting angle may be in the range of less than 10 degrees, preferably less than 5 degrees.

It may be preferred that the marking head is a page-wide marking head, that is, the marking head has a width corresponding to the width of an object to be marked, wherein the width of the object is defined as the dimension of the object in a transverse direction, in particular the direction perpendicular to the advance direction. The direction perpendicular to the advance direction may be referred to as the orthogonal direction. The object may therefore be marked by moving the marking head in the advance direction without overlaying a further movement of the marking head in the transverse direction and/or the orthogonal direction. The advance direction, which may also be called the object movement direction, may be in particular a linear direction.

In a preferred embodiment the receiving spaces are arranged in a regular rectangular pattern and the amount of offset of the receiving spaces of a successive row with regard to the receiving spaces of a preceding row is smaller than a pitch of the receiving spaces of one row.

The pitch of the receiving spaces, which is also called the device pitch, is the distance between the central points of two adjoining receiving spaces. The amount of offset corresponds to a marking line or scan line pitch, which is the distance between two adjoining marking or scan lines in the transverse direction, in particular the orthogonal direction. Moreover, the amount of offset can be described as the distance in the orthogonal direction between two corresponding receiving spaces of neighbouring or adjoining rows or as the distance in the orthogonal direction between two adjoining receiving spaces of one column. Thus, the receiving spaces are preferably arranged in a way, that the marking line pitch or scan line pitch is smaller than the device pitch.

It may be particularly preferred that the array is tilted to a degree, in which at least a part of the receiving spaces of at least one row of the rectangular pattern is aligned with at least a part of the receiving spaces of at least one preceding row in the advance direction. With this embodiment, it is possible to place a marking device and a sensor device such that they are aligned in the product movement direction, although the array is tilted. This provides the possibility of detecting a marking applied by a marking device in conjunction with a tilted array having an enhanced resolution of marking as compared to a non-tilted array.

In order to variably adapt the resolution of the marking it may be preferable that the marking head is rotatable about an axis perpendicular to the advance direction, in particular perpendicular to a surface of the object to be marked. The rotational marking head may allow for a flexible adjustment of the resolution of the marking apparatus. Moreover, with the rotational marking head it is possible to set up a tilt angle of the marking head in which the sensor devices are aligned with the marking devices in the advance direction.

For a precise movement of the marking head it may be preferred that a motor, in particular a stepper motor, is provided for rotating the marking head, in particular at defined small angle steps in the range of 0 to 90 degrees. The small angle steps may be in particular steps of less than 1 degree, for example less than 0.1 degrees. The motor may in particular be an electrical motor.

It may be preferred that the marking head comprises a receiving plate with a plurality of receiving holes, in which the marking devices and the sensor devices are arranged. The receiving holes may in particular be through-holes.

In a further preferred embodiment the marking devices and the sensor devices may include ferrules with fibre ends arranged therein. The combination of marking and sensor devices each including ferrules may provide a flexible marking apparatus, in which the marking devices and sensor devices may be arranged in the receiving spaces in a flexible manner. The ferrules of the marking devices and sensor devices may be inserted into the receiving holes of the marking head, so that the ferrules are each coupled to the receiving plate in a defined position.

For holding the ferrules tight and removable in the receiving holes, it may be preferred that a capture pad is arranged at at least one surface of the receiving plate. It may be preferred that the capture pad includes an elastic polymer, in particular a rubber and/or an elastomer. The capture pad is preferably made of viton® (a registered trademark of E. I. du Pont de Nemours and Company, Delaware, USA) or includes the material viton®. The ferrules may be pushed through the capture pad and are then held in place by the capture pad as it closes the ferrule after insertion. The ferrules can be removed by simply pushing back through from one side of the receiving plate.

The ferrules of the marking devices and the ferrules of the sensor devices may preferably have equal or corresponding connector sections, so that a receiving space of the marking head may be selectively equipped with a marking device or a sensor device.

A ferrule of a marking device or a sensor device includes at least one fibre arranged therein. In case of a marking device, the at least one fibre may be coupled to a lighting element, for example a laser for marking or engraving the object by means of a laser beam. In case of a sensor device, the at least one fibre may be coupled to a sensor element for detecting light received through the fibre.

Another preferred embodiment of the invention may be characterized in that the plurality of marking devices and sensor devices includes at least one integrated marking and sensor device comprising a ferrule with at least one first fibre connectable to a marking element for marking the object and at least one second fibre connectable to a sensor element for detecting the marking on the object.

The marking element may in particular be a laser for emitting a laser beam for marking the object. The sensor element may in particular be an optical sensor element such as a photosensor or photodetector. The photosensor or photodetector can for example be a photodiode, a phototransistor, or a photoresistor.

The integrated marking and sensor device allows for an integrated marking and verification of the applied marking in one pixel, that is, in one receiving space of the marking head. The marking may be applied through the first fibre, which may be called a delivery fibre, and the presence of the marking may be detected by the second fibre, which may be called a receiving fibre. According to the invention, the receiving fibre may be arranged downstream of the delivery fibre in the advance direction.

The integrated marking and sensor device can in particular be employed as an online pixel monitor for recognizing failed pixels or a fibre break during a marking operation.

The second fibre can be used to detect a reflected laser beam from the first fibre to verify that a marking was made.

The integrated marking and sensor device can also be used as a power monitor for measuring the power of the laser beam. To this end, a mirror coating may be applied onto the end of one of the fibres. A portion of the power in the delivery fibre can be directed to a detector or sensor element for determining the power of the laser beam. The detected power can for example be used to provide feedback for constant power control and/or for code verification, that is, verification of the presence of a marking applied, in particular the presence of a plume or reflected power to verify that a marking was made or a spot was printed.

In particular in connection with the integrated marking and sensor device it may be preferred that at least one lens is provided in front of the ferrule. The lens may reflect a part of the light emitted by the first fibre, so that the reflected light is receivable by the second fibre.

BRIEF DESCRIPTION OF THE DRAWINGS

The invention will be further described with reference to the attached figures, wherein.

In all figures, identical components are identified by identical reference signs.

DETAILED DESCRIPTION OF THE INVENTION

Figure 1:
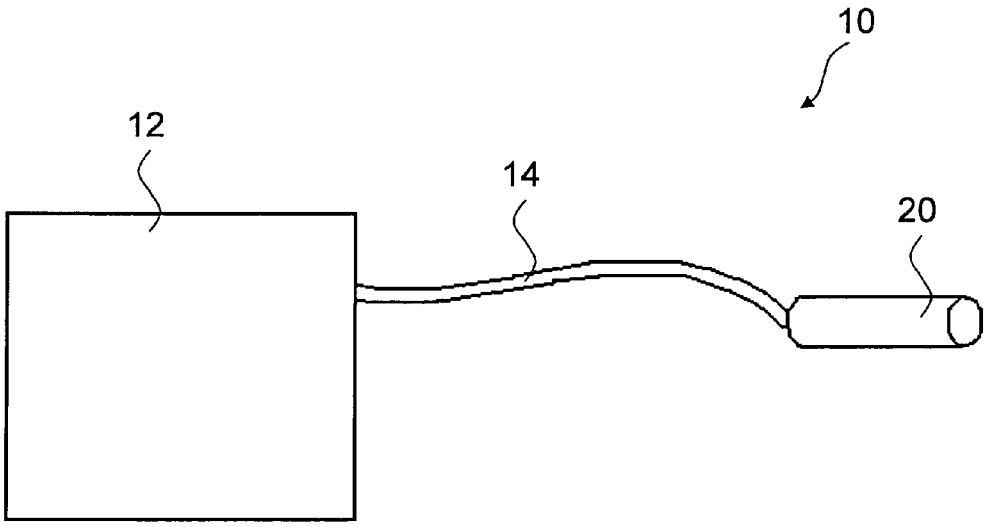
FIG. 1 shows an inventive marking apparatus.

A principle structure of a marking apparatus 10 is shown in FIG. 1. The marking apparatus 10 comprises a marking head 20 with a plurality of marking devices 40 and a plurality of sensor devices 50. The apparatus 10 further comprises a control and driving unit 12 for controlling the marking devices 40 and the sensor devices 50. The control and driving unit 12 is connected to the marking head 20 through an umbilical 14. The umbilical 14 may have a plurality of fibres arranged therein.

Figure 2:
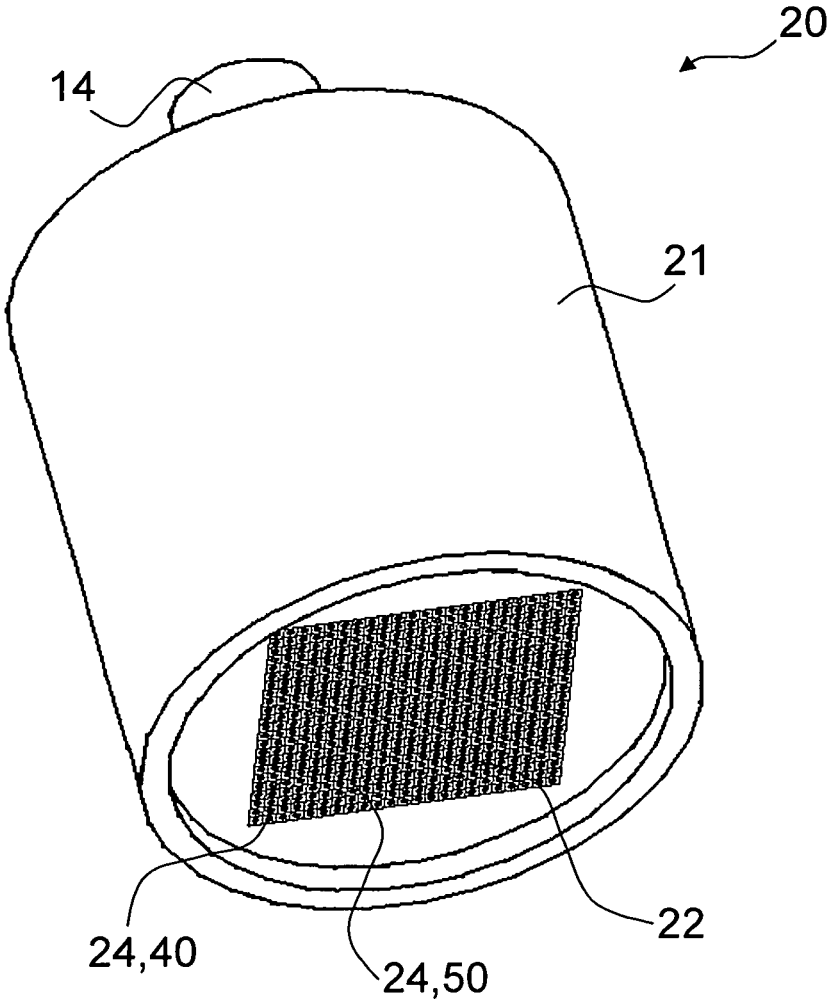
FIG. 2 shows a perspective view of an inventive marking head.

FIG. 2 shows a general embodiment of a marking head 20, which can in particular be a printing head. The marking head 20 comprises a housing 21, which in the shown embodiment has a cylindrical outer shape.

The marking head 20 includes a plurality of receiving spaces 24 arranged in a two-dimensional array 22. The receiving spaces 24 are equipped with individual marking devices 40 and sensor devices 50. The sensor devices 50 may also be referred to as scanning devices.

Figure 3:
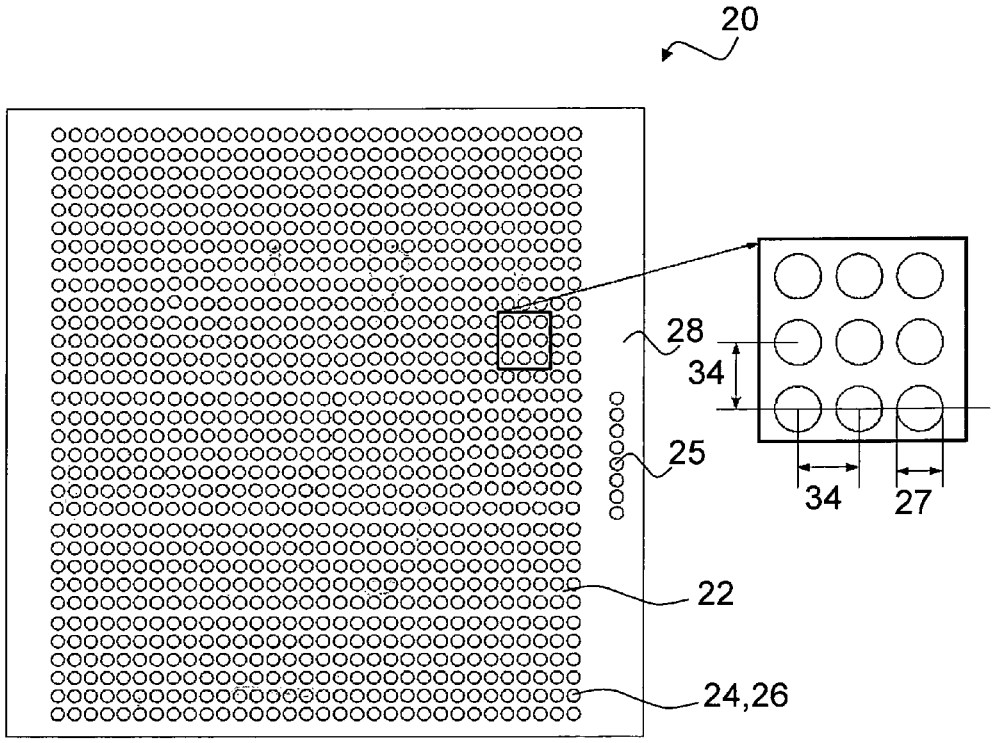
FIG. 3 shows an empty array of receiving spaces.

An empty array 22 of receiving spaces 24 is shown in FIG. 3. The receiving spaces 24 are arranged in rows 30 and columns 32 extending perpendicularly to each other. In other words, the receiving spaces 24 are arranged in a rectangular or square pattern, which may also be called a matrix, in particular a two-dimensional matrix.

Moreover, the receiving spaces 24 have equal distances or an equal spacing, so that a regular pattern is formed. The spacing between to adjacent receiving spaces 24, more particularly the distance between the central points of two adjacent receiving spaces 24 in one row 30 or column 32, is called a device pitch 34. The receiving spaces 24 have equal device pitches 34 in the row direction and in the column direction. The array 22 of receiving spaces 24 has a rectangular outer shape.

The marking head 20 includes a receiving plate 28 having a plurality of receiving holes 26 forming the receiving spaces 24. The receiving plate 28 may for example be a metal plate, in particular a steel plate. The receiving holes 26 each have a substantially circular cross-section and may in particular be through holes. The receiving holes 26 have equal diameters 27.

In addition to the array 22 of receiving spaces 24, a plurality of spare receiving spaces 25 is provided for accommodating spare marking and/or spare sensor devices. The spare receiving spaces 25 are also formed as receiving holes in the receiving plate 28 and may in particular be positioned outside the array 22, as shown in FIG. 3.

Figure 4:
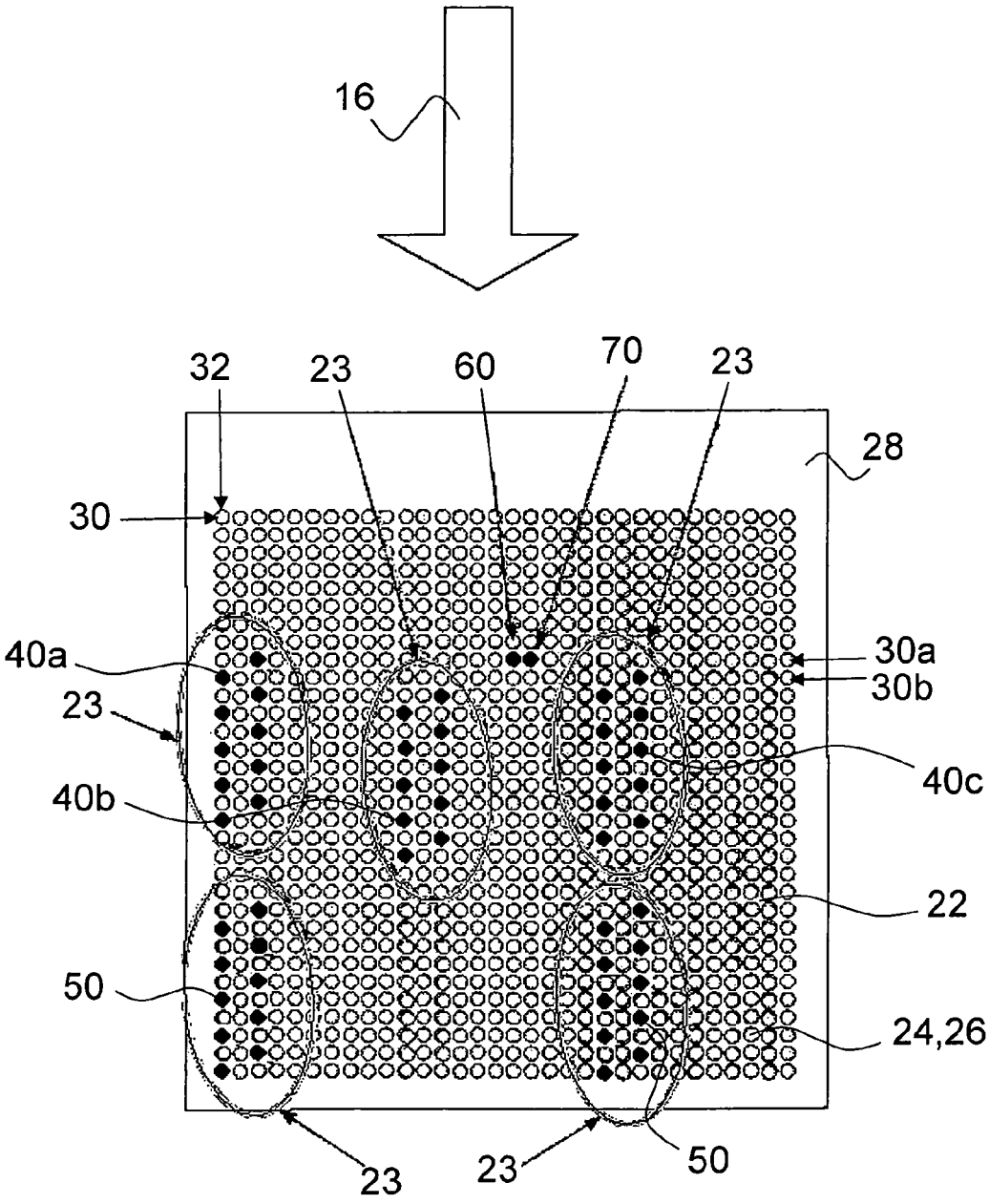
FIG. 4 shows an array of receiving spaces, which is equipped with a plurality of marking devices and a plurality of sensor devices.

FIG. 4 shows a marking head 20 with an array of receiving spaces 24, wherein the receiving spaces 24 are equipped with a plurality of marking devices 40 and a plurality of sensor devices 50.

The marking devices 40 include a plurality of marking devices 40*a*, 40*b*, 40*c*, which are arranged in individual subarrays 23. The marking devices 40*a*, 40*b*, 40*c* may be of different types for performing different marking tasks. For example, the marking devices 40*a* may be ink jet nozzles, the marking devices 40*b* may be $CO_2$ laser ferrules and the marking devices 40*c* may be laser diode ferrules. The ink jet nozzles may for example be used to print on a PVC cap. The $CO_2$ laser ferrules may be used to print on an object 8 having varying distances to the marking devices 40. The laser diode ferrules can for example be used to print on paper.

The sensor devices 50, for example sensor ferrules, are arranged downstream of the marking devices 40 in an advance direction 16 of the object 8. The sensor devices 50 are arranged in a way that a marking applied by the marking devices 40 can be verified by the sensor devices 50. To this end, the sensor devices 50 are at least partly aligned with the marking devices 40 in the advance direction 16. The sensor devices 50 may also be arranged in individual sub-arrays 23 corresponding to the sub-arrays 23 of the marking devices 40.

In particular, a plurality of sensor devices 50 is positioned in a manner that each of the sensor devices 50 is aligned with one of the marking devices 40. In other words, each of the marking devices 40 is provided with or related to at least one sensor device 50 for verification of the marking applied by the respective marking device 40. The number of sensor devices 50 in the marking head 20 is therefore equal to or greater than the number of marking devices 40. With this configuration, the marking of each of the marking devices 40 may be individually verified or monitored.

In addition to the marking devices 40 and the sensor devices 50 a measuring device 60 is arranged in one of the receiving spaces 24. The measuring device 60 is configured to measure a speed of the object 8 in the advance direction 16.

Moreover, the marking head 20 includes a detector device 70 for detecting the presence of the object 8 to be marked.

Figure 5:
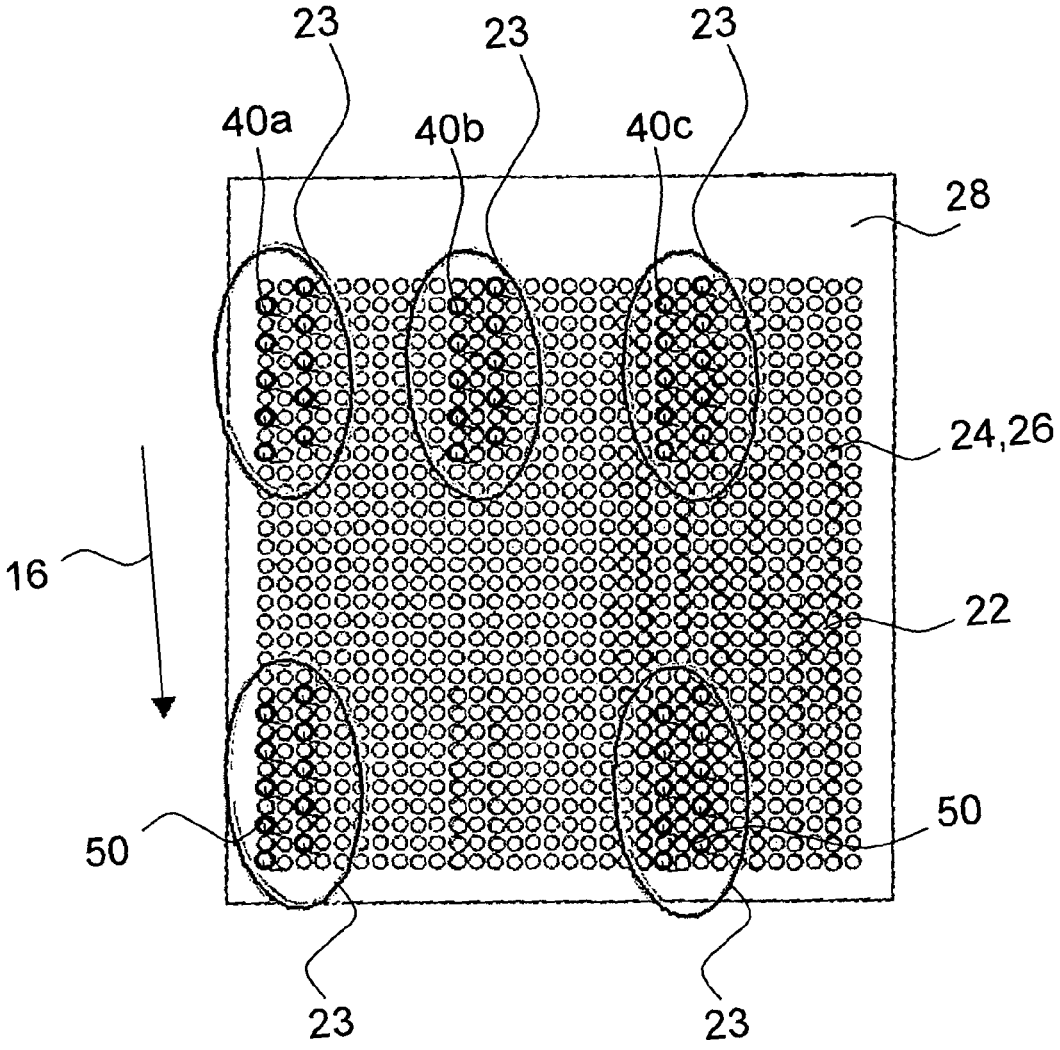
FIG. 5 shows a tilted array of receiving spaces, which is equipped with a plurality of marking devices and a plurality of sensor devices.

FIG. 5 shows a tilted array 22 of receiving spaces 24 similar to the array illustrated in FIG. 4. As in FIG. 4, the receiving spaces 24 are equipped with a plurality of marking devices 40 and a plurality of sensor devices 50.

A difference between the configuration of FIG. 4 and the configuration of FIG. 5 is that the array 22 according to FIG. 5 is tilted or inclined with regard to the advance direction 16. The tilted position is defined in particular in that the rectangular pattern of rows 30 and columns 32 is tilted from a position in which the columns 32 are aligned with the advance direction 16 to a position in which the columns 32 are inclined or slanted with regard to the advance direction 16.

The tilted position of the array 22 or marking head 20, respectively, enhances the maximum possible resolution of the marking and/or scanning. In a preferred embodiment, as shown in FIG. 5, the array 22 is tilted to a degree, such that the resolution is defined by the number of rows 30 times the number of columns 32, that is, by the mathematical product of the number of rows 30 and the number of columns 32. To this end, the array 22 is tilted to a degree, where the receiving spaces 24 of a successive row 30*b* are slightly offset with regard to the receiving spaces 24 of a preceding row 30*a*, in particular such that the receiving spaces 24 overlap in the transverse direction.

With the tilted array 22 of receiving spaces 24, respectively marking devices 40 and/or sensor devices 50, the resolution of the marking in the transverse direction is enhanced. In particular, a marking line pitch or scan line pitch, which is defined as a distance between two adjoining marking or scanning lines in the transverse direction, is smaller than the device pitch 34.

Figure 6:
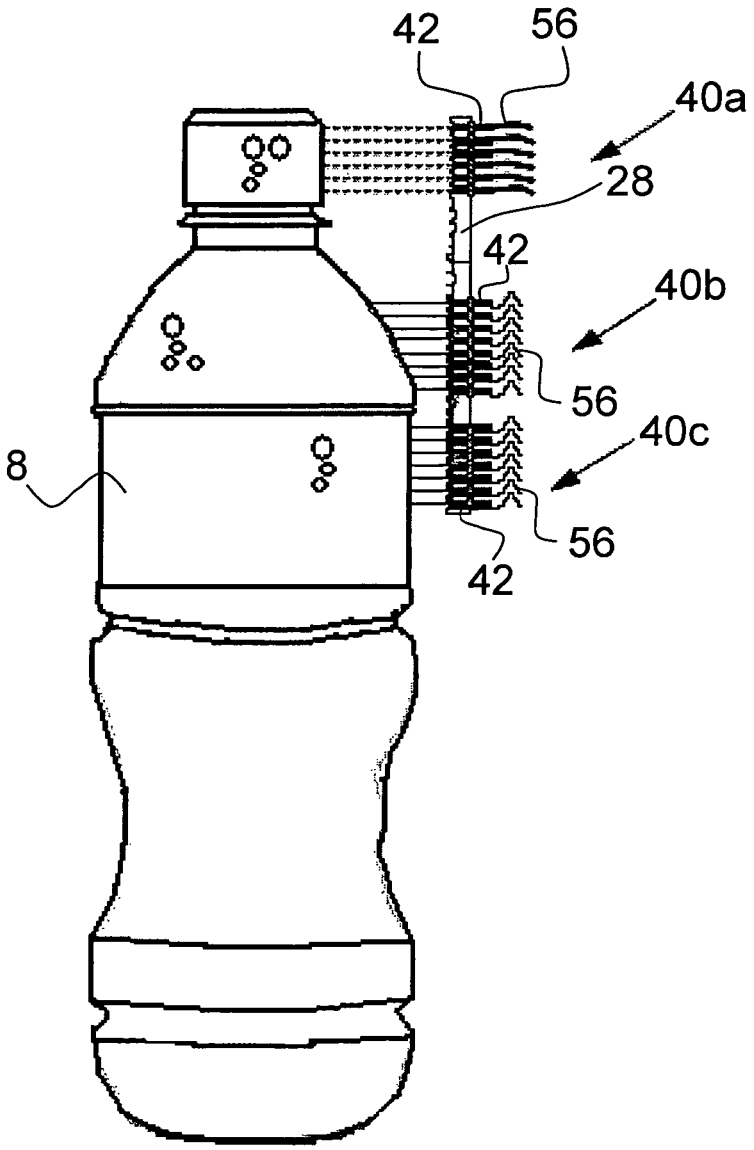
FIG. 6 shows an object having been marked using the array according to FIG. 5.

FIG. 6 illustrates an example of an object 8 marked or printed by the marking head 20 according to FIG. 5.

In another preferred embodiment not explicitly shown in the figures, the marking head 20 is inclined to a position, in which a certain number of receiving spaces 24 is aligned with other receiving spaces 24 in the advance direction 16. In order to verify the marking applied by the marking devices 40, the sensor devices 50 are positioned such that they are aligned with the marking devices 40 in the tilted marking head 20, respectively array 22. The principle of such a tilted array 22 allowing for a multiple mark or scan option will be described later on with reference to FIG. 8.

Figure 7:
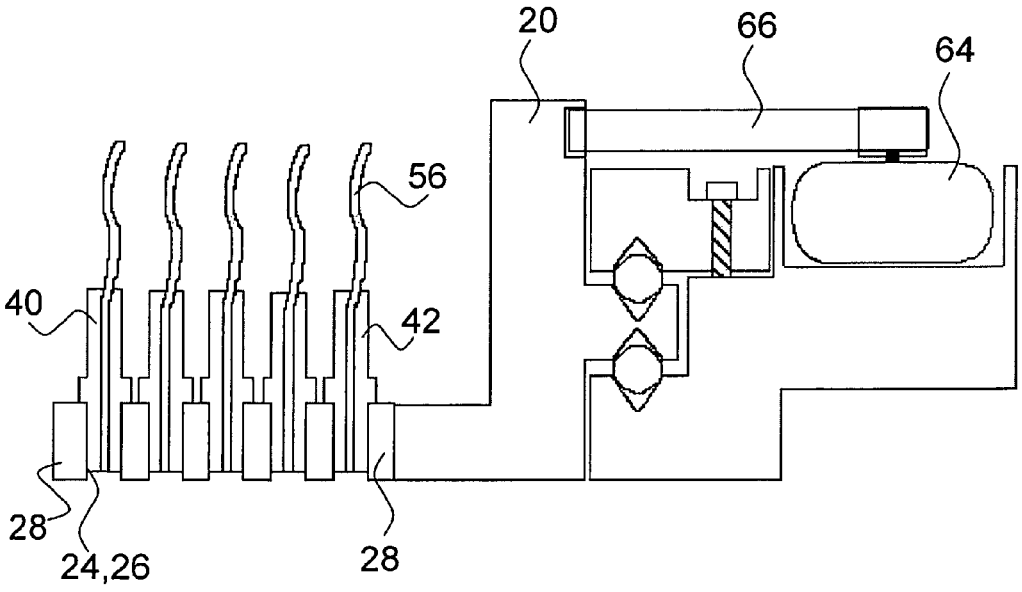
FIG. 7 shows a cross-sectional view of a rotatable marking head.

FIG. 7 shows a cross-sectional view of a marking head 20 comprising a receiving plate 28 with receiving holes 26, in which marking devices 40 and sensor devices 50 (not shown) are arranged.

The receiving holes 26 are formed as through-holes. The marking devices 40 each comprise a ferrule 42, in which at least one fibre end of a fibre 56 is arranged. In a corresponding manner, the sensor devices 50 can also comprise ferrules 42 and can in particular each have a shape corresponding to the shape of the marking devices 40, so that the receiving holes 26 may be selectively equipped with marking devices 40 and sensor devices 50.

A motor 64, in particular a stepper motor, is arranged for rotating the marking head 20 and/or the receiving plate 28. A transmission 66, which in the shown embodiment is a belt, is arranged between an output shaft of the motor 64 and the marking head 20 for transmitting a rotational motion of the output shaft to the marking head 20 and/or the receiving plate 28.

Figure 8:
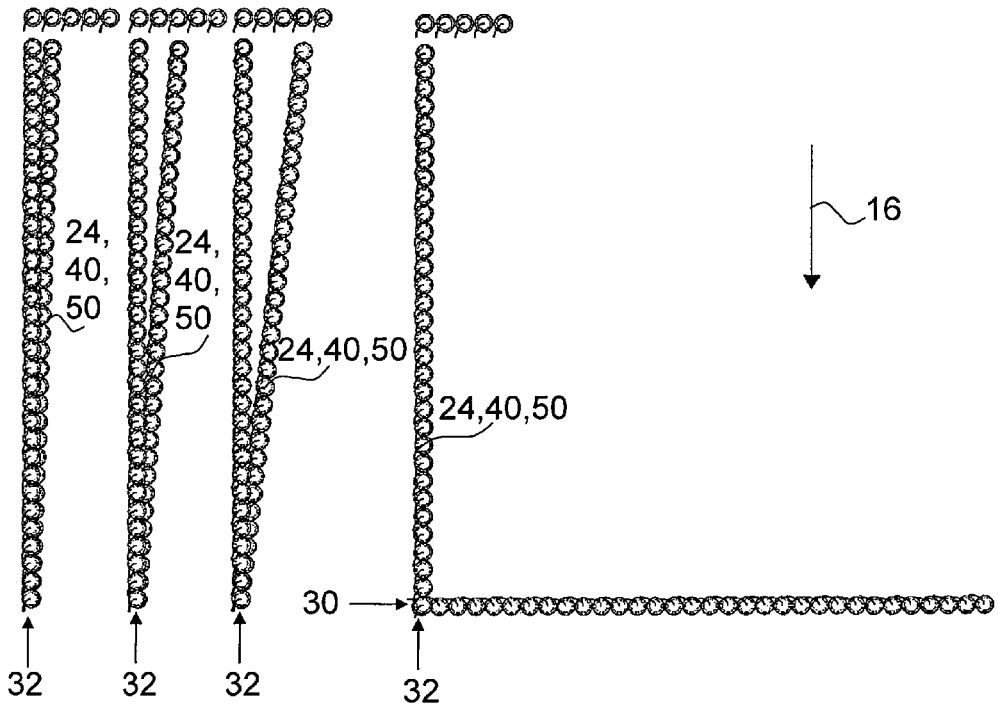
FIG. 8 shows the general principle of a multiple mark or scan option.

FIG. 8 schematically shows different tilting angles of an array 22. In the left representation of FIG. 8 the array 22 is tilted to a degree in which each of the receiving spaces 24 of one column 32 are offset with regard to all other receiving spaces 24 of the same column 32, so that only one single mark or scan per pixel is possible. That is, if the receiving spaces 24 of one column 32 are equipped with marking devices 40, the marking devices 40 are offset with regard to any other marking devices 40 of the same column 32. With this configuration the maximum resolution of a given marking head 20 may be achieved.

In the middle representation the array 22 is tilted to a degree in which a double mark or scan of any pixel is possible. That is, the receiving spaces 24 of one column 32 correspond to the receiving spaces 24 of another column 32 such that one and the same pixel may be marked by two different marking devices 40 arranged in different columns 32 or a sensor device 50 may be arranged in an aligned position with a marking device 40 for verification of a marking applied by the marking device 40.

In the next representation the array 22 is tilted to a degree in which a triple mark or scan of any pixel is possible. That is, the receiving spaces 24 of one column 32 correspond to the receiving spaces 24 of two other columns 32 such that one and the same pixel may be marked by three different marking devices 40 arranged in different columns 32 or at least one sensor device 50 may be arranged in an aligned position with at least one marking device 40.

The right representation shows the array 22 in a non-inclined position.

Figure 9:
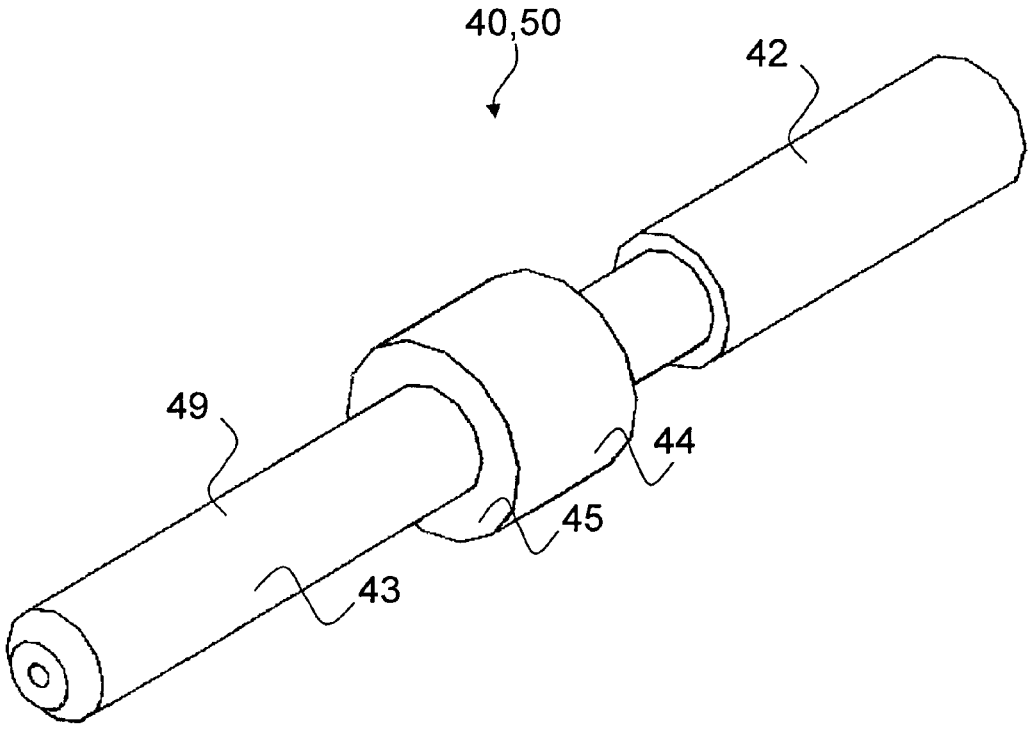
FIG. 9 shows a perspective view of a ferrule to be inserted into a receiving space of a marking head.

FIG. 9 schematically shows a perspective view of an embodiment of a ferrule 42, which may form a part of a marking device 40 or a sensor device 50. The ferrule 42 is configured for a mating engagement with the receiving spaces 24, in particular the receiving holes 26, of the marking head 20.

The ferrule 42 has a substantially cylindrical body 43 and can for example include a metal, a ceramic, a plastic material or glass. It is particularly preferred that the ferrule 42 includes steal or zirconia.

The body 43 of the ferrule 42 has a connecting portion or a connector section 49 for engaging a receiving space 24 of the marking head 20. The connector section 49 has a substantially cylindrical shape for a mating engagement with a cylindrical receiving hole 26 provided in the receiving plate 28 of a marking head 20. The body 43 of the ferrule 42 further comprises a collar 44 with an abutment surface 45 for contacting a planar surface of the receiving plate 28.

At least one optical fibre 56 is arranged in the ferrule 42 for receiving light reflected from the object 8 or transmitting light or radiation to it. The at least one fibre 56 is arranged along a longitudinal axis of the ferrule 42.

If the ferrule 42 is used as a part of a marking device 40, it may be preferred that the at least one optical fibre 56 is configured to transmit a laser beam onto a surface of the object 8 for a laser marking operation, in particular a laser engraving operation. To this end, the fibre 56 may be coupled to a laser so that a laser beam is transmittable through the fibre 56 onto a surface of the object 8 for marking the object 8.

If the ferrule 42 is used as a part of a sensor device 50, it may be preferred that the at least one optical fibre 56 is configured to receive light reflected by the object 8. The light can be any kind of electromagnetic radiation such as for example visible light or infrared light. The at least one fibre 56 may be connected to a sensor element for detecting the light received by the fibre 56.

Figure 10:
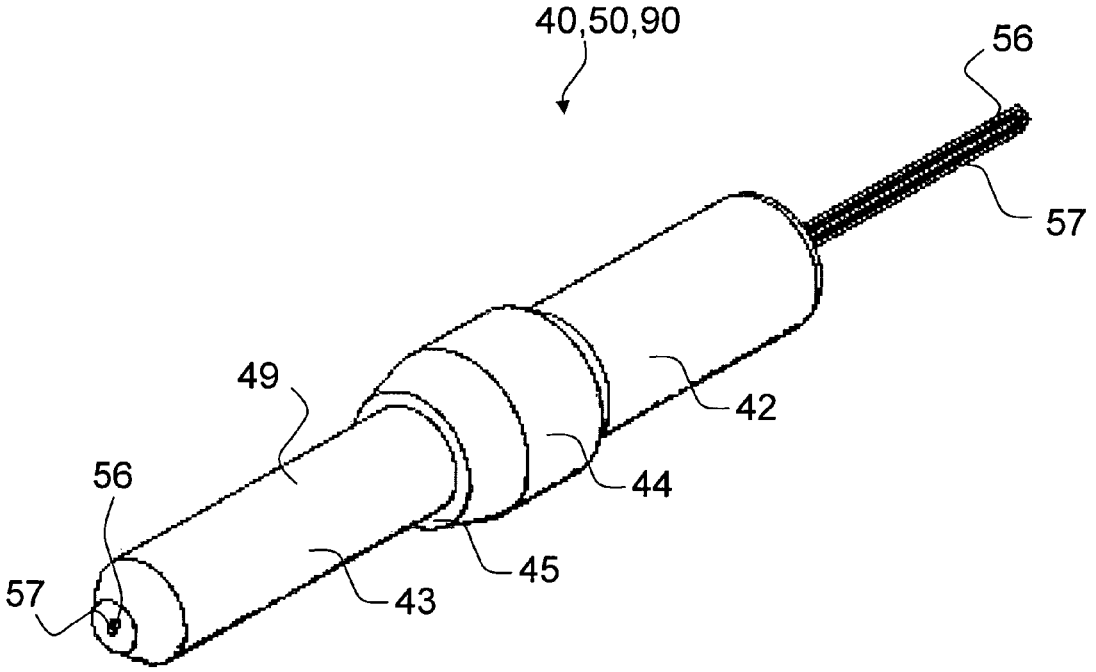
FIG. 10 shows a perspective view of a ferrule with a delivery fibre and a receiving fibre.

FIG. 10 illustrates a ferrule 42 with two fibres 56, 57 arranged therein. The ferrule 42 with two fibres 56, 57 may form a part of an integrated marking and sensor device 90, wherein one of the two fibres, a first fibre 56, is a marking or delivery fibre and the other fibre, a second fibre 57, is a sensor fibre.

The two-fibre ferrule 42 provides a marking element and a verification element in the same pixel, that is, in the same receiving space 24 of the marking head 20. The marking may be applied through the first fibre 56, which may be coupled to a laser, and the presence of the marking may be detected by the second fibre 57, which may be preferably coupled to a sensor element.

When ferrules 42 are used both as marking devices 40 and as sensor devices 50, it may be preferred that a fibre diameter of the sensor device 50 is greater than a fibre diameter of the marking device 40, so that the marking can be detected even when the sensor device 50 is not exactly aligned with the marking device 40.

The invention claimed is:

1. A marking apparatus for marking an object comprising:

a marking head having a plurality of marking devices for applying a marking on the object and a driving mechanism for providing a relative movement of the object relative to the marking head in an advance direction during a marking operation, wherein the marking head comprises in addition to the plurality of marking devices a plurality of sensor devices, wherein the sensor devices are arranged downstream of the marking devices in the advance direction, so that the marking applied by the marking devices is detectable by the sensor devices, when the object is moved relative to the marking head in the advance direction, wherein the marking head is rotatable about an axis that is perpendicular to the advance direction and to a surface of the object to be marked in order to variably adapt the resolution of the marking, wherein the marking devices and the sensor devices are arranged in a fixed relative position to each other in the marking head, and wherein the marking head comprises a receiving plate with a plurality of receiving holes, in which the marking devices and the sensor devices are arranged.

2. The marking apparatus of claim 1, wherein the marking head comprises a plurality of receiving spaces, in which the marking devices and the sensor devices are arranged.

3. The marking apparatus of claim 2, wherein the receiving spaces are arranged in a plurality of rows and columns, such that a two-dimensional array of receiving spaces is formed.

4. The marking apparatus of claim 3, wherein the rows and columns, in which the receiving spaces are arranged, extend perpendicular to each other.

5. The marking apparatus of claim 3, wherein the array of receiving spaces is tilted with regard to the advance direction, wherein the rows extend in a transverse direction relative to the advance direction and the receiving spaces of a successive row are offset with regard to the receiving spaces of a preceding row in the transverse direction.

6. The marking apparatus of claim 1, wherein the marking devices and the sensor devices have corresponding connector sections for being variably coupled to the receiving spaces of the marking head.

7. The marking apparatus of claim 1, wherein the plurality of marking devices and sensor devices includes at least one integrated marking and sensor device comprising a ferrule with at least one first fibre connectable to a marking element for marking the object and at least one second fibre connectable to a sensor element for detecting the marking on the object.

8. The marking apparatus of claim 1, wherein the marking head is configured to rotate about the axis that is perpendicular to the advance direction and to the surface of the object to be marked to variably adapt the resolution of the marking made by the marking head.

9. A method for marking an object, the method comprising:

a marking is applied by a plurality of marking devices, the object is moved relative to the marking devices in an advance direction during a marking operation, the marking applied by the marking devices is detected by a plurality of sensor devices, which are arranged downstream of the marking devices in the advance direction, and the marking head is rotated about an axis that is perpendicular to the advance direction and to a surface of the object to be marked in order to variably adapt the resolution of the marking wherein the marking devices and the sensor devices are arranged in a fixed relative position to each other in the marking head, wherein the marking head comprises a receiving plate with a plurality of receiving holes, in which the marking devices and the sensor devices are arranged.

10. The method of claim 9, wherein the marking head is configured to rotate about the axis that is perpendicular to the advance direction and to the surface of the object to be marked to variably adapt the resolution of the marking made by the marking head.

* * * * *